US005540160A

United States Patent [19]

Rea

[11] Patent Number: 5,540,160

[45] Date of Patent: Jul. 30, 1996

[54] SEWING TABLE AND CHAIR

[75] Inventor: Raymond Rea, Bassett, Va.

[73] Assignee: Pluma, Inc., Eden, N.C.

[21] Appl. No.: 240,268

[22] Filed: May 10, 1994

[51] Int. Cl.[6] ..... D05B 25/00; D05B 75/00

[52] U.S. Cl. ..... 112/217.2; 108/147; 297/135

[58] Field of Search ..... 112/217.1, 217.2, 112/217.3, 261; 108/5, 20, 21, 65, 144–148, 50; 312/208.5, 235.2, 235.9, 237, 372, 394, 319.5, 319.9; 248/188.2, 188.4, 188.5, 919, 920; 297/135, 138, 147, 161, 164, 217, 142, 241

[56] References Cited

U.S. PATENT DOCUMENTS

| | | | |
|---|---|---|---|
| 823,005 | 6/1906 | Thompson | 112/217.2 |
| 958,800 | 5/1910 | Gibbins | 112/217.1 |
| 1,195,626 | 8/1916 | Thum | 297/172 |
| 1,342,686 | 6/1920 | McCracken | 112/217.2 |
| 2,183,366 | 12/1939 | Chason et al. | 112/217.2 |
| 2,306,812 | 12/1942 | Ketive | 297/217.7 X |
| 2,348,043 | 5/1944 | Webb et al. | 248/669 |
| 3,964,575 | 6/1976 | Gostling | 248/188.4 X |
| 4,116,146 | 9/1978 | Matthews | 112/217.2 |
| 4,732,088 | 3/1988 | Koechlin et al. | 108/64 |
| 4,852,500 | 8/1989 | Ryburg et al. | 248/919 X |
| 4,901,658 | 2/1990 | Sanvito et al. | 112/217.2 |
| 4,993,782 | 2/1991 | Williams | 312/21 |
| 5,265,952 | 11/1993 | Greshem et al. | 108/147 X |

FOREIGN PATENT DOCUMENTS

| | | | |
|---|---|---|---|
| 2839770 | 3/1980 | Germany | 108/64 |
| 2922945 | 12/1980 | Germany | 297/142 |
| 851385 | 10/1990 | United Kingdom | 312/235.9 |

*Primary Examiner*—Ismael Izaguirre
*Attorney, Agent, or Firm*—Rhodes Coats & Bennett L.L.P.

[57] ABSTRACT

A sewings work station which has a plurality of work positions. The sewing station includes a horizontal top having of a first work surface adapted to support a first sewing machine, a second work surface at an angle to the first work surface adapted to support a second sewing machine, and a bottom surface. A plurality of vertically adjustable legs support the top and include leg adjusters adapted to simultaneously adjust the length the legs equal amounts, whereby the top may be positioned at different heights for different operators. In the preferred embodiment, the sewing station further includes an articulated arm having a fixed end attached to the station and a free end moveable between positions in front of the first and second work surfaces, and a chair mounted on the free end of the arm.

14 Claims, 4 Drawing Sheets

SEWING TABLE AND CHAIR

BACKGROUND OF THE INVENTION (1) Field of the Invention

The present invention relates generally to sewing and, more particularly, to a sewing work station having an adjustable work table and, chair.

(2) Description of the Prior Art

The usual modern day practice is to assemble garments in teams of four to eight sewing operators each performing one or two sewing operations. This "work chain" has been necessary, in large part, to the inability of most commercial sewing machines to perform multiple stitching types. This method has several drawbacks.

For example, the semi-completed goods must be re-bundled and un-bundled between each operator. In addition, the speed of the team tends to be governed by the lowest speed operator. Finally, it is difficult to determine the source of quality problems which arise after the garments are completed.

U.S. Pat. No. 4,901,658, issued to Sanvito, teaches one way to overcome these problems. Sanvito discloses a work station to stitch manufactured items. The work station includes a supporting frame on which is mounted a work table for supporting three machines which extend around the operator to allow a manufactured item to be removed from one sewing machine to another whereby one operator can complete the garment. However, the work table taught by Sanvito does not include any means for adjusting the work table height quickly for different operators working different shifts. In addition, Sanvito does not teach any means of coupling the work table and operator chair together to allow movement of the chair from position to position while, at the same time, preventing the tendency of the chair to roll back during working.

Thus, there remains a need for a new and improved sewing work station which allows a single operator to perform multiple sewing operations, includes means for adjusting the work table height quickly for different operators working different shifts, and couples the work table and operator chair together to allow movement of the chair from position to position while, at the same time, preventing the tendency of the chair to roll back during working.

SUMMARY OF THE INVENTION

The present invention is directed to a sewing work station which has a plurality of work positions. The sewing station includes a horizontal top having of a first work surface adapted to support a first sewing machine, a second work surface at an angle to the first work surface adapted to support a second sewing machine, and a bottom surface. A plurality of vertically adjustable legs support the top and include leg adjusters adapted to simultaneously adjust the length the legs equal amounts, whereby the top may be positioned at different heights for different operators.

In the preferred embodiment, the first sewing machine is adapted to perform overlock operations and the second sewing machine is adapted to perform cover-seaming operations.

Also, in the preferred embodiment, the sewing station further includes an articulated arm having a fixed end attached to the station and a free end moveable between positions in front of the first and second work surfaces, and a chair mounted on the free end of the arm.

Accordingly, one aspect of the present invention is to provide an adjustable table for supporting a pair of sewing machines positioned at an angle to each other. The table includes: (a) a horizontal top having a first work surface adapted to support a first sewing machine, a second work surface at an angle to the first work surface and attached to the first work surface at a common juncture adapted to support a second sewing machine, and a bottom surface; (b) a plurality of vertically adjustable legs supporting the top; and (c) leg adjusters adapted to simultaneously adjust the length the legs equal amounts, whereby the top may be positioned at different heights.

Another aspect of the present invention is to provide an adjustable table for supporting a pair of sewing machines positioned at an angle to each other. The table includes: (a) a horizontal top having a first work surface adapted to support a first sewing machine, a second work surface at an angle to the first work surface adapted to support a second sewing machine, and a bottom surface; (b) a plurality of vertically adjustable legs supporting the top; (c) leg adjusters adapted to simultaneously adjust the length the legs equal amounts, whereby the top may be positioned at different heights; (d) a frame beneath the top, the leg adjuster being positioned on the frame; (e) an articulated arm having a fixed end attached to the frame and a free end moveable between positions in front of the first and second work surfaces; and (f) a chair mounted on the free end of the arm.

Still another aspect of the present invention is to provide an adjustable sewing station having a plurality of work positions. The sewing station includes: (a) a horizontal top having a first work surface adapted to support a first sewing machine, a second work surface at an angle to the first work surface adapted to support a second sewing machine, and a bottom surface; (b) a first sewing machine supported by the first work surface; (c) a second sewing machine supported by the second work surface; (d) a plurality of vertically adjustable legs supporting the top; and (e) leg adjusters adapted to simultaneously adjust the length the legs equal amounts, whereby the top may be positioned at different heights.

These and other aspects of the present invention will become apparent to those skilled in the art after a reading of the following description of the preferred embodiment when considered with the drawings.

DESCRIPTION OF THE PREFERRED EMBODIMENTS

Figure 1:
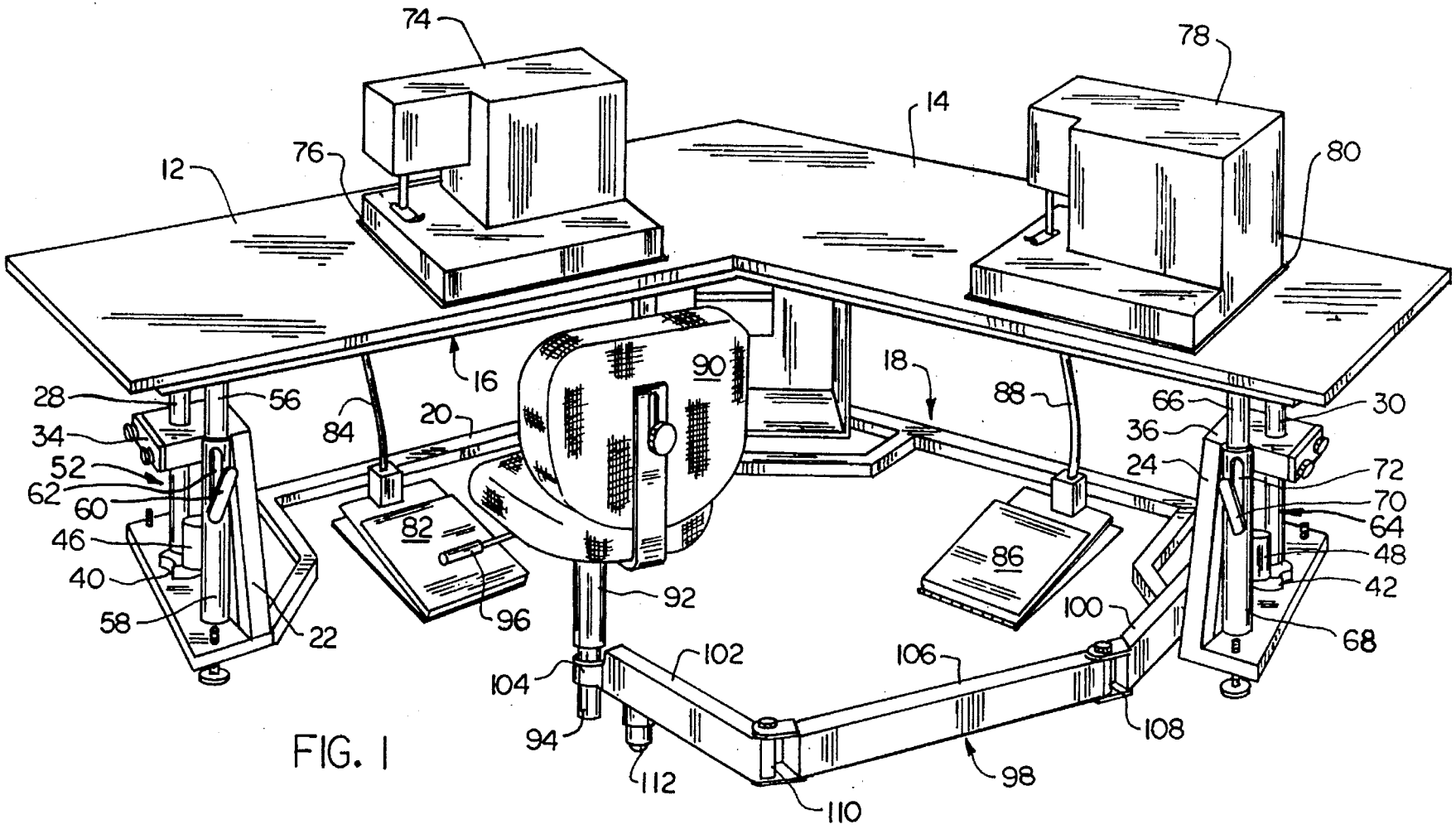
FIG. 1 is a front, perspective view of a sewing machine table constructed according to the present invention as seen from the operator's side.
Figure 2:
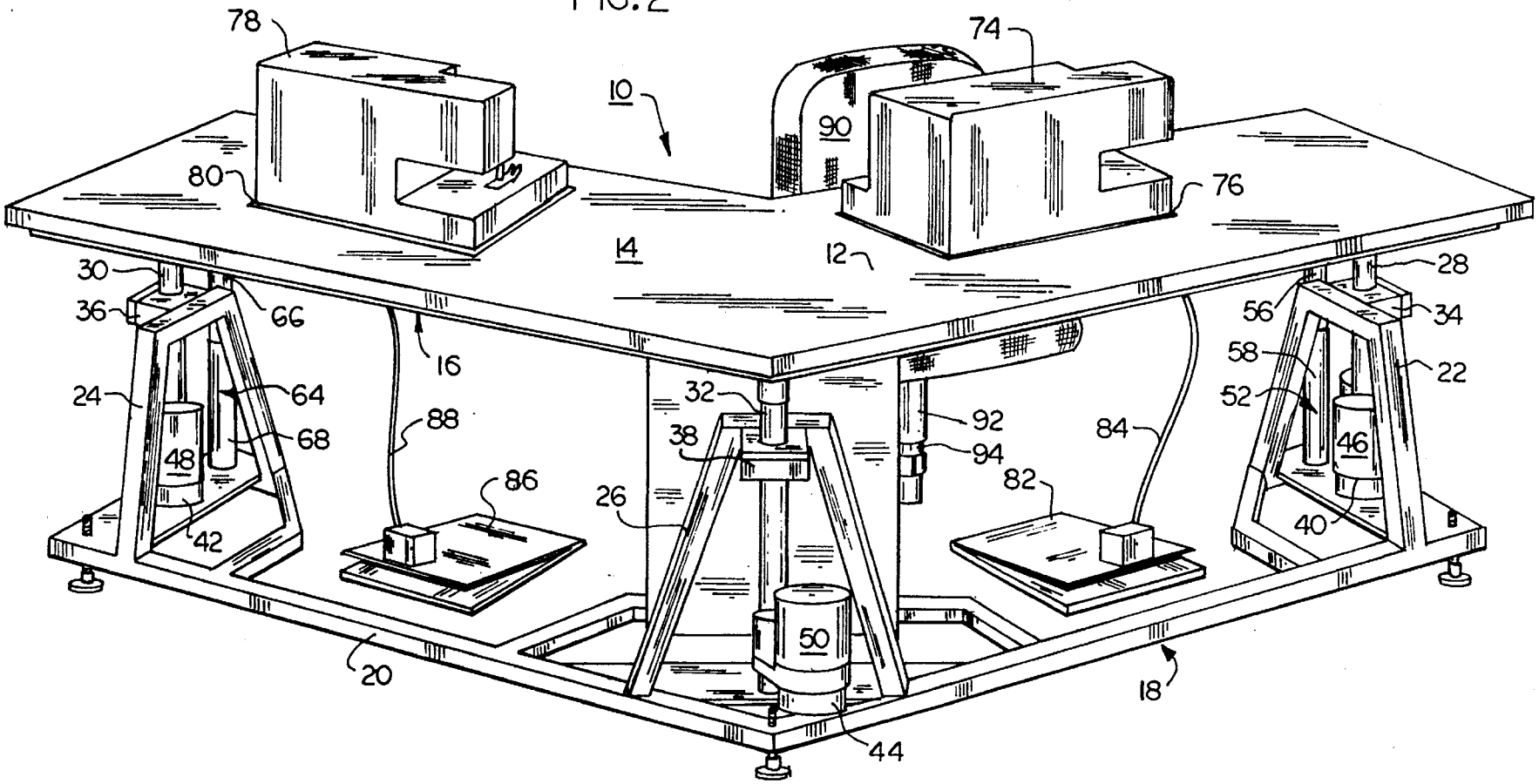
FIG. 2 is a rear, perspective, view of the sewing machine table as seen from the side opposite the operator.
Figure 3:
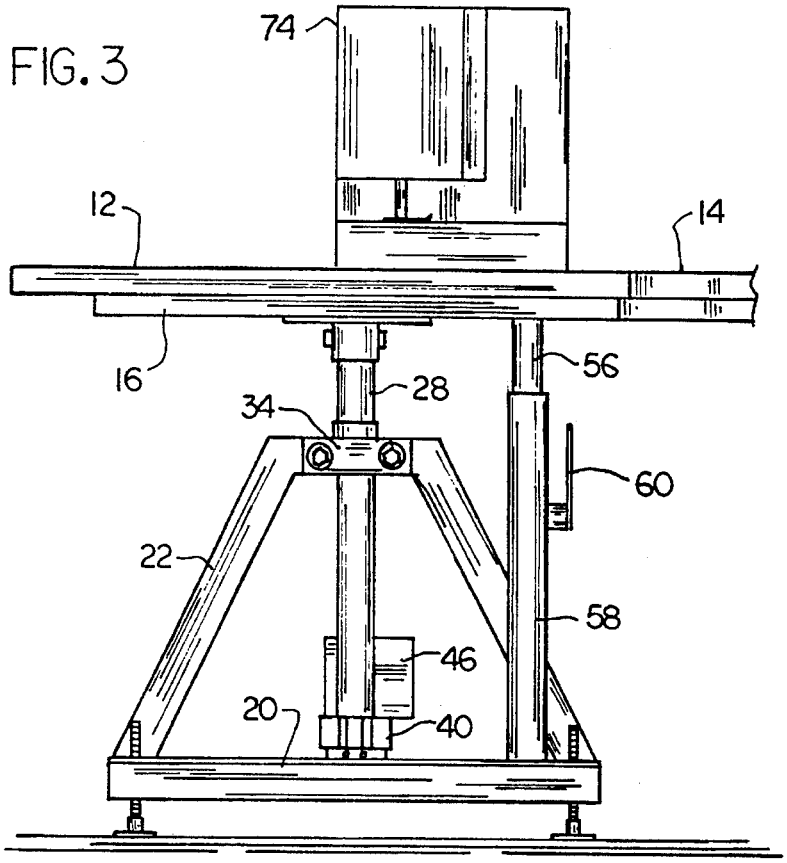
FIG. 3 is an elevation view of the left end of the sewing machine table.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, the sewing machine table of the present invention includes a horizontal top, 10, which has a left work surface 12 to support a first sewing machine, a right work surface 14 to support a second sewing machine positioned at a right angle to surface 12 and connected thereto at a central juncture, and a bottom surface 16 extending beneath surfaces 12 and 14.

Top 10 is supported above a frame, generally 18, which includes a horizontal frame member 20, a left vertical member 22 positioned under left work surface 12, a right vertical member 24 positioned under right work surface 14, and a center vertical member 26 centrally positioned under top 10 at the juncture of surfaces 12 and 14.

Top 10 is supported on frame 18, and is vertically adjustable in relation thereto, by vertical, telescoping legs 28, 30 and 32, each having an upper end affixed to bottom surface 16 of top 10. Leg 28 is positioned below surface 12, and is held in a vertical position by mounting block 34 on vertical member 22. Similarly, legs 30 and 32 are held in a vertical position by mounting blocks 36 and 38 on vertical members 24 and 26, respectively.

Vertical positioning, i.e., up and down adjustment, of top 10 is achieved by extending and retracting legs 28, 30 and 32 with leg adjusters having gears 40, 42, and 44, engaging legs, 28, 30 and 32, respectively, and electric motors 46, 48, and 50, to turn gears 40, 42, and 44, which, in turn, impart vertical motion to legs 28, 30, and 32 in a known manner. Motors 46, 48, and 50, which are connected by cables, not shown, to a source of electricity, are synchronized to simultaneously vertically position legs 28, 30 and 32 respectively, equal distances when activated. As legs 28, 30, and 32 are extended or retracted, top 10 is correspondingly raised or lowered.

Top 10 is further supported on frame 20 by a pair of vertical, telescoping safety legs, generally 52 and 54. Leg 52, which is located beneath left work surface 12, includes a vertical shaft 56 with an upper end connected to bottom surface 18 of top 10 and a lower end movable within vertical sleeve 58, which has its lower end connected to frame 18.

A locking handle 60 extends through vertical slot 62 in sleeve 58 and screws into shaft 56. Clockwise rotation of handle 60 locks movement of shaft 56 in sleeve 58, and thus prevents top 10 from accidentally falling on an operator's legs, while counter-clockwise rotation frees shaft 56 for vertical movement.

Similarly, telescoping safety leg 64 is connected to bottom surface 18 of top 10 beneath right work surface 14 and includes vertical shaft 66 moveable within vertical sleeve 68, with vertical movement being prevented by locking handle 70 which extends through slot 72 in sleeve 68 and into rotatable connection with shaft 66.

A first sewing machine 74 is supported within a centrally located opening 76 in work surface 14, and a second sewing machine 78 is supported within a centrally located opening 80 in work surface 16 at a right angle to sewing machine 74. In the preferred embodiment, sewing machine 74 is a machine of the type used to perform overlock operations, and sewing machine 78 is a machine of the type used to perform cover-seaming operations. Obviously, different machines may be supported within openings 76 and 80 depending on the kind of sewing operations required. Machines 74 and 78 are of well known configuration, and thus are not shown in detail.

Sewing machine 74 is activated by foot pedal 82, which rests on the floor generally beneath work surface 14 and is connected to sewing machine 74 by a cable 84. A second foot pedal 86 rests on the floor generally beneath work surface 16, and activates sewing machine 78 by way of cable 88.

A rotatable operator chair 90, is mounted on the upper end of vertical, telescoping hydraulic cylinder 92, which has a lower shaft 94. Operation of hydraulic cylinder 92, and thus control of the height of chair 90, is by way of actuator handle 96.

Cylinder 92 is of the type commonly found on secretarial chairs, for example, and includes a piston slidable within an air-tight, closed cylinder containing a spring. A port permits entry or exit of air to or from the cylinder when opened, e.g., by an actuator handle.

When the port is opened and the piston is pressed downward, the chair can be moved to a lower position, and when the port is opened without pressure on the piston, the chair will move to a higher position under action of the spring. The interior details of cylinder 92 have not been illustrated due to their well-known nature.

Chair 90 is supported by an articulated arm, generally 98, which has a fixed end attached to frame 18, and a free end moveable between positions in front of work surfaces 12 and 14. Arm 98 includes a fixed segment 100 attached to frame 16; an end segment 102, which includes a clamp 104,to hold shaft 94, and thus support chair 90; and an intermediate segment 106, connected to segments 100 and 102 with vertical hinges 108 and 110. A rest 112 beneath segment 102 contacts the floor when an operator sits in chair 90, to support the operator's weight.

Figure 4:
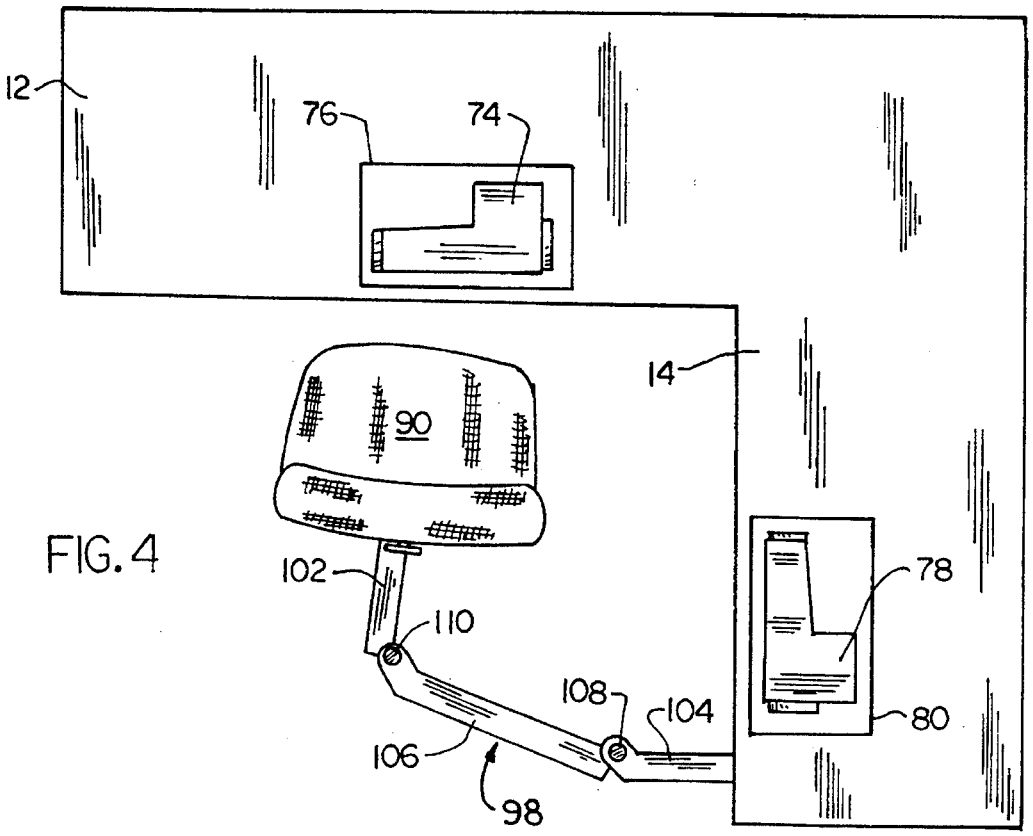
FIG. 4 is a top view of the sewing machine table with the chair positioned before one of the sewing machines.
Figure 5:
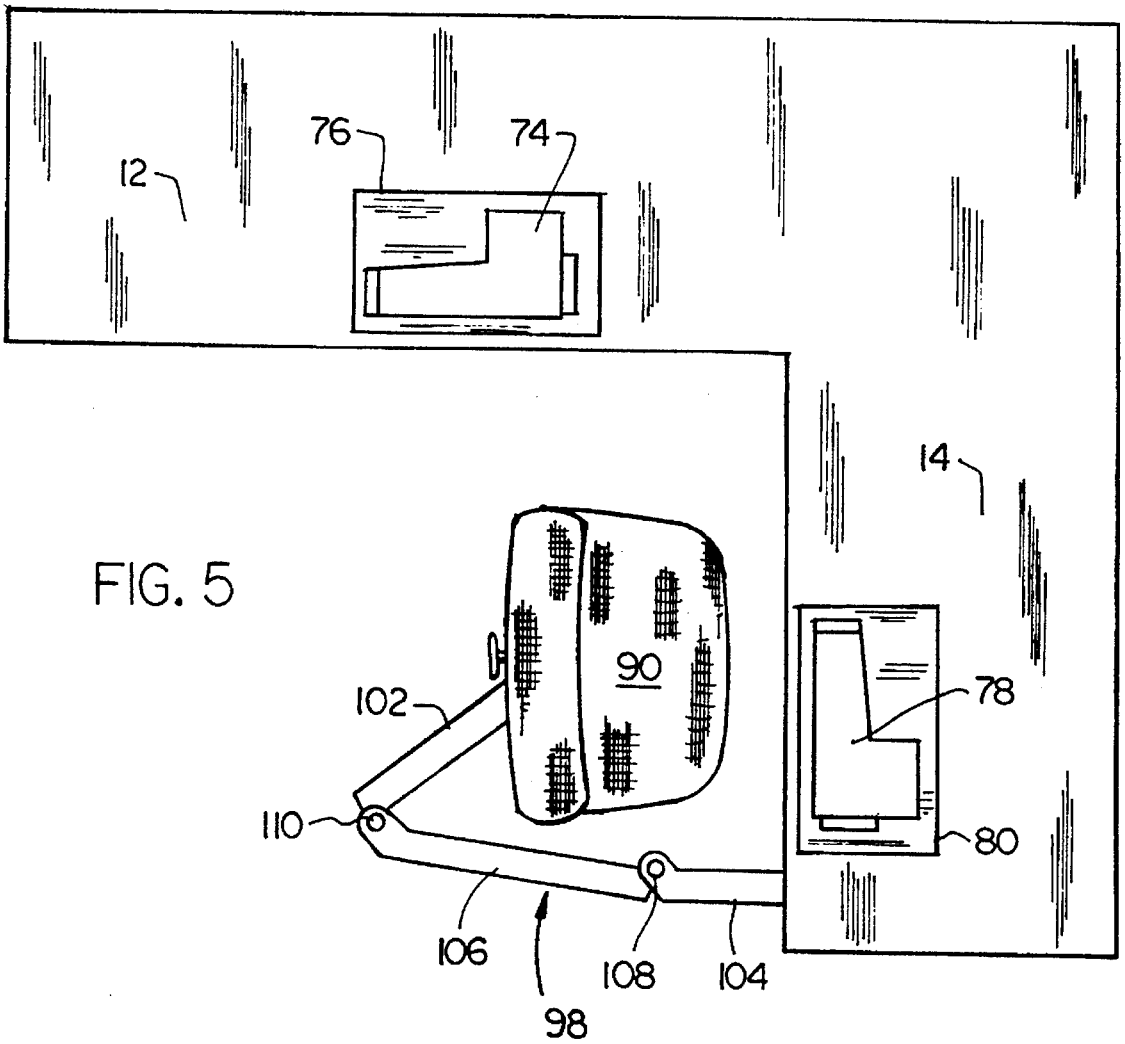
FIG. 5 is a top view of the sewing machine table with the chair positioned before the other sewing machine.

The capability to move articulated arm 98 is freely moveable in a horizontal plane in front of top 10, thus allows the operator to position chair 90 at any location desired. For example, FIG. 4 shows the chair positioned in front of left work surface 12 and before machine 74, while FIG. 5 shows the chair positioned in front of right work surface 14 and before machine 78.

Different machine operators will require different positioning of the height of the sewing machine top as well as the height and position of the chair relative to the top, as a result of their different sizes or work styles. The sewing machine table just described permits a variety of adjustments to satisfy these requirements. In addition, the table just described allows the operator to readily move from the desired position in front of one machine to a desired position in front of a second machine.

In operation, the oncoming sewing machine operator, if desiring a different table and/or chair position from those used by the previous operator, energizes motors 50, 54 and 58, which turn gears 48, 52 and 56, thus raising or lowering legs 30, 32 and 34 equal distances to change the vertical position of top 10. If desired, the operator can also draw the chair to the desired position in front of either sewing machine 80 or sewing machine 84, and can raise or lower seat 96 with handle 102. Thus, the work position of the operator relative to work surface height, proximity to the sewing machine, and seat height are fully adjustable, providing maximum ergonomic comfort.

Certain modifications and improvements will occur to those skilled in the art upon a reading of the foregoing description. By way of example, other drive mechanisms, such as fluid cylinders, can be used to vertically adjust legs 28, 30 and 32. Also, sewing machines 74 and 78 may be positioned at other than a right angle. It should be understood that all such modifications and improvements have been deleted herein for the sake of conciseness and readability but are properly within the scope of the following claims.

I claim:

1. An adjustable table for supporting a pair of sewing machines positioned at an angle to each other, said table comprising:

(a) a horizontal top having a first work surface adapted to support a first sewing machine, a second work surface at an angle to said first work surface and attached to said first work surface at a common juncture adapted to support a second sewing machine, and a bottom surface;

(b) a plurality of vertically adjustable legs supporting said top;

(c) leg adjusters adapted to simultaneously adjust the length of said legs equal amounts, to position said top at different heights;

(d) a frame supporting said top;

(e) an articulated arm having a fixed end attached to said frame and a free end adapted to support a seat, said arm being freely moveable within a horizontal plane in front of said first and second work surfaces; and (f) a seat supported on the free end of said arm.

2. The apparatus according to claim 1, wherein said leg adjusters includes gears engaging said legs and electric motors to turn said gears.

3. The apparatus according to claim 1, wherein said frame is located generally beneath said top, and said leg adjusters are positioned on said frame.

4. The apparatus according to claim 1, wherein said plurality of legs includes a first leg positioned beneath said first work surface, a second leg positioned beneath said second work surface, and a third leg beneath the juncture of said first and second work surfaces.

5. The apparatus according to claim 1, wherein said second work surface is at a right angle to said first work surface.

6. The apparatus according to claim 1, further including telescoping, lockable legs extending from the lower surface of said top to said frame.

7. An adjustable table for supporting a pair of sewing machines positioned at an angle to each other, said table comprising:

(a) a horizontal top including a first work surface adapted to support a first sewing machine, a second work surface at an angle to said first work surface adapted to support a second sewing machine, and a bottom surface;

(b) a plurality of vertically adjustable legs supporting said top;

(c) leg adjusters adapted to simultaneously adjust the length said legs equal amounts, to position said top at different heights;

(d) a frame beneath said top, said leg adjusters being positioned on said frame;

(e) an articulated arm having a fixed segment mounted on said frame, an end segment having a clamp for holding a chair, and an intermediate segment attached at its ends to said fixed and end segments by vertical hinges, whereby said articulated arm is freely moveable within a horizontal plane in front of said first and second work surfaces; and (f) a chair mounted on said end segment.

8. The apparatus according to claim 7; further including a support beneath said end segment to support the weight of a person sitting in said chair.

9. An adjustable sewing station having a plurality of work positions, said station comprising:

(a) a horizontal top including a first work surface adapted to support a first sewing machine, a second work surface at an angle to said first work surface adapted to support a second sewing machine, and a bottom surface;

(b) a first sewing machine supported by said first work surface;

(c) a second sewing machine supported by said second work surface;

(d) a plurality of vertically adjustable legs supporting said top; and (e) a leg elevation system adapted to simultaneously adjust the length of each of said legs an equal amount to position said top at different heights.

10. The apparatus according to claim 9, wherein said first sewing machine is adapted to perform overlock operations and said second sewing machine is adapted to perform cover-seaming operations.

11. The apparatus according to claim 9, further including a frame located generally beneath said top, said leg adjusters being positioned on said frame.

12. The apparatus according to claim 9, further including an articulated arm having a fixed end attached to said frame and a free end moveable between positions in front of said first and second work surfaces, and a chair mounted on said free end of said arm.

13. The apparatus according to claim 9, wherein said leg elevation system includes at least one electric drive.

14. The apparatus according to claim 9, wherein said leg elevation system includes at least one fluid actuator.

* * * * *